United States Patent [19]

Schuster

[11] Patent Number: 4,808,136

[45] Date of Patent: Feb. 28, 1989

[54] MERCURY RETENTION STRUCTURE FOR INTRODUCTION OF MEASURED AMOUNTS OF MERCURY INTO A LAMP AND METHOD OF MAKING THE RETENTION STRUCTURE

[75] Inventor: Werner Schuster, Eching/A., Fed. Rep. of Germany

[73] Assignee: Patent Treuhand Gesellschaft für elektrische Glühlampen mbH, Munich, Fed. Rep. of Germany

[21] Appl. No.: 246,904

[22] Filed: Sep. 16, 1988

Related U.S. Application Data

[63] Continuation of Ser. No. 934,195, Nov. 24, 1986, abandoned.

[30] Foreign Application Priority Data

Dec. 19, 1985 [DE] Fed. Rep. of Germany ..... 3545048
Dec. 19, 1985 [DE] Fed. Rep. of Germany ..... 3545073

[51] Int. Cl.[4] ..... H01J 7/10

[52] U.S. Cl. ..... 445/9; 75/81; 252/181.6; 313/565

[58] Field of Search ..... 445/9; 313/565; 252/181.1, 181.6; 75/81; 204/99, 140, 105 R

[56] References Cited

U.S. PATENT DOCUMENTS 2,651,737 9/1953 Marshall ..... 313/565 X
2,929,705 3/1960 Hohn et al. ..... 75/81 X
3,243,284 3/1966 Morelock et al. ..... 75/81
4,282,455 8/1981 Latassa et al. ..... 313/177
4,661,078 4/1987 Grossman et al. ..... 445/9

*Primary Examiner*—Kenneth J. Ramsey
*Attorney, Agent, or Firm*—Frishauf, Holtz, Goodman & Woodward

[57] ABSTRACT

To be able to handle minute quantities of liquid mercury or liquid mercury alloy, for example to introduce said minute quantities into the discharge vessel of a discharge lamp, a retention body in form of a pill or pellet is formed which is a porous of a metal or mixture of metals or metal alloys which have a melting point above 250° C., are not wetted by mercury, and do not form an alloy with mercury. To make such a body which, for example, is made of iron, iron and copper—to reduce oxidation, nickel and copper or iron, chromium and possibly also nickel, a metal salt of the respective metal is electrolytically enriched with mercury to form a mercury—metal suspension; in case of several metals, the suspensions are mixed, coated with aqueous-free glycerine, tempered, washed, dried, non-absorbed mercury is filtered off, and the resulting filter cake is pressed out at high pressure, of 5 to $60 \cdot 10^7$ Pascal; the brittle pressed body is pulverized and pellets of dimensions of about 1.5 mm by under 0.5 mm height are formed as press bodies, the mercury content of which can be controlled within suitable ranges by controlling the pressing-out pressure.

28 Claims, 2 Drawing Sheets

Figure 1:
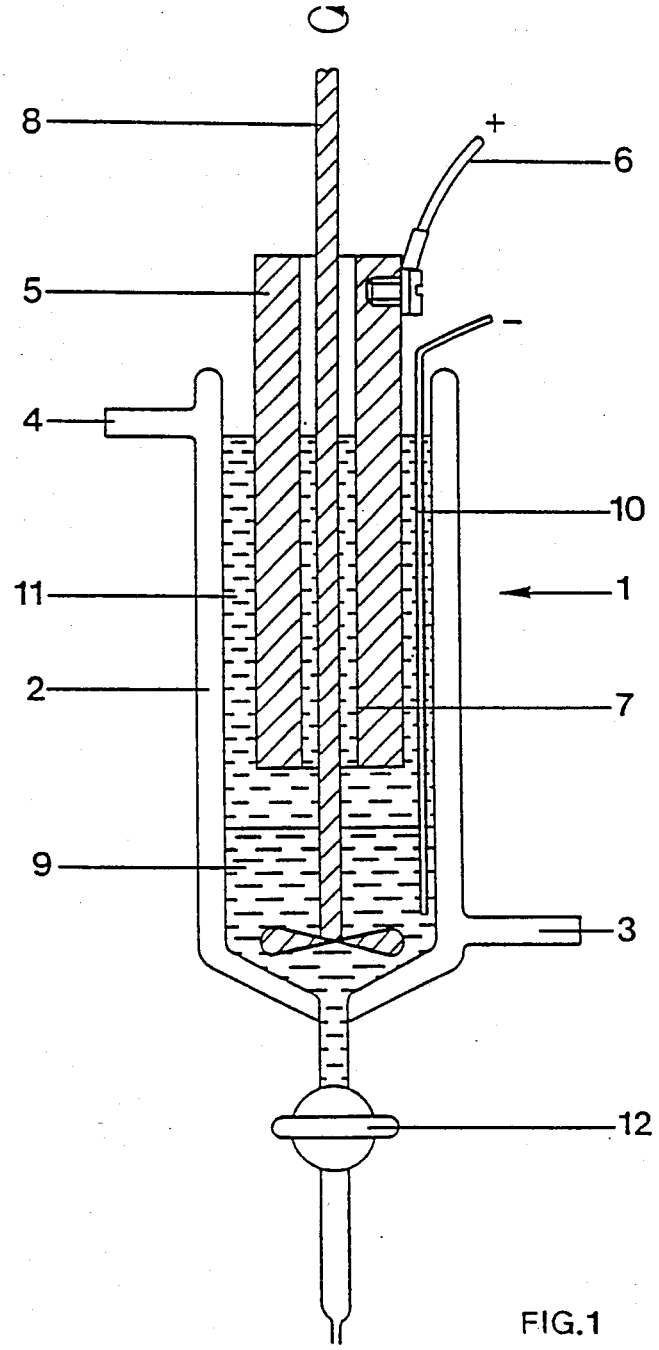

MERCURY RETENTION STRUCTURE FOR INTRODUCTION OF MEASURED AMOUNTS OF MERCURY INTO A LAMP AND METHOD OF MAKING THE RETENTION STRUCTURE

This application is a continuation of application Ser. No. 934,195, filed Nov. 24, 1986, now abandoned.

The present invention relates to the art of handling mercury, and more particularly to handling of minute quantities of mercury for introduction of minute quantities of mercury into lamp vessels, for example into discharge lamps, specially into low-pressure discharge lamps, such as fluorescent lamps. The mercury may be present as pure or essentially pure mercury, or in the form of a liquid mercury

BACKGROUND

Practically all discharge lamps utilize mercury enclosed within the discharge lamp vessel which vaporizes during operation. In high-pressure discharge lamps, the mercury is introduced in the form of a halide mercury compound, or by directly introducing a drop through an exhaust tube into the discharge vessel. In low-pressure discharge lamps, for example fluorescent lamps, it is customary to either use direct drop-in introduction of mercury or to use containers made of glass or metal into which the mercury or the mercury alloy is filled. The container is secured close to an electrode within the interior of the discharge vessel, and by induced high frequency or laser beams is opened after the vessel has been sealed to permit the mercury to escape. U.S. Pat. No. 4,282,455 illustrates such an arrangement and process.

It is extremely difficult, and practically impossible, to properly proportion minute amounts of mercury due to the high surface tension. Thus, dosing or measuring liquid mercury in minute quantities is very difficult. Consequently, the lamps will retain in many instances a substantially larger quantity of mercury than is actually needed for operation. Direct introduction of liquid mercury is also impeded by retention of mercury drops on the stem of an exhaust tube. This may occur when the drops are below a predetermined small minimum size.

It has been proposed by colleagues of the inventor hereof to utilize a process in which liquid mercury is formed in a long strip, for example in a trough, and cooled below its freezing point. The frozen filamentary or rod-like mercury then is divided into parts having the requisite length. In other words, the required quantity of mercury is severed from the frozen strand, and the so severed part introduced into the discharge vessel. This method provides for much better and more accurate proportioning and introduction of the appropriate amount of mercury. However, it has also been found that in high-volume production, it is very difficult to be carried out since the required cooling and cold-introduction elements must be integrated with existing lamp production machinery, which is difficult to achieve without substantial redesign of expensive large-scale high-production apparatus.

Handling liquid mercury is not only dangerous but also toxic; handling such liquid mercury thus results in placing substantial stresses on the environment and working places. Mercury has a relatively high vapor pressure, and the vapor is highly toxic. If a drop of mercury falls off a container on a hard surface, it has the tendency to spray off into tiny droplets which are extremely difficult to retrieve.

THE INVENTION

It is an object to improve introduction of mercury into a vessel, typically into a lamp vessel, and especially into a low-pressure or fluorescent lamp discharge vessel, which is simple, effective and safe, and does not interfere with the physical characteristics of the mercury or a mercury alloy, for example its high vapor pressure; and to provide a method to make a mercury retention structure so that the mercury can be introduced into the respective vessel in such a retention structure.

Briefly, and in accordance with a feature of the invention, a retention structure is formed as a porous press body or press element which stores a predetermined quantity of mercury in its pores. The press structure is made of a metal having a melting point of above 250° C., the metal of the porous press structure being selected such that it will not form an alloy with the mercury, while being capable of being wetted by mercury, and, additionally, having high resistance to oxidation. The press body need not be a single metal but, rather, may be formed of various metals or alloys, in which the metal, metals, or alloys in turn do not alloy with mercury, while being capable of being wetted by mercury and having the melting point above 250° C. The alloy may include a metal which forms a major portion, that is, more than 50% of the press body, with a further component metal which increases the resistance to oxidation of the first metal.

In the description that follows, and unless otherwise indicated, all component percentages will be by weight.

The first, or only metal used may be one of the fourth to eighth subgroups of the periodic system, for example iron, nickel or the like; as a second metal, which improves the resistance to oxidation, copper, chromium and nickel may be used. A suitable composition, for example, may be 75% to 99.5% iron, the remainder 25% to 0.5% by weight of copper. Another press element may have 55% to 80% nickel, the remainder 45% to 20% copper; or a press body may be made having 65% to 75% iron, 12% to 25% chromium, and the remainder 23% to 0% nickel.

A press element of the composition in accordance with the invention is capable of storing, per unit weight of the metal, a precisely determinable quantity of mercury or mercury alloy, as will be described in detail below. It has been found by actual measurements that press bodies from different batches prepared under similar conditions, will retain mercury in a quantity which varies by at the most ±10% Thus, by weighing the press body, a desired quantity of mercury or mercury alloy, respectively, can be obtained, even within a milligram range. The press body can be introduced simply into the discharge vessel. It does not lose mercury, either upon intermediate storage or stocking, or upon touching.

Long-term storage should be carried out under vacuum, or within a protective gas since, due to the high vapor pressure of mercury, it would evaporate in a normal atmosphere.

Introduction of mercury in excessive quantities in a lamp thus is not necessary.

The embodiment of the invention has the advantage that the press element can be easily introduced into a lamp, for example by attaching it to the exhaust tube, for example within the exhaust tube, thereby additionally preventing removal of luminescent phosphor coating from a lamp which otherwise might occur upon introduction of liquid mercury by dropping liquid mercury into the lamp. The mercury is freed from the press element upon application of heat which is obtained in a lamp upon heating of the electrodes.

In accordance with a feature of the invention, the retention body is made by introducing mercury or the liquid mercury alloy in one or more electrolysis vessels. The electrolysis vessels may have different metal salt solutions therein. Anodes of the respective metals are provided, which metal or metals have the characteristic that they alone or as an alloy or mixture,themselves,do not alloy with mercury, while being capable of being wetted by mercury, and have high resistance to oxidation. The metals of the metal salt solutions, and the anodes, may be iron and copper, the metal salt solutions, if desired, may also include chromium and possibly nickel.

The mercury or the mercury alloy is electrolytically enriched with the respective metal of the salt solution, so that one or more mercury metal suspensions are formed. In case a plurality of mercury metal suspensions are formed, they are mixed in predetermined proportions, and the resulting mercury metal suspension product is coated with glycerine, free from water, and tempered at at least 100° C. The glycerine is decanted, the suspension produced washed and dried, and the excess, nonabsorbed mercury, or the excess non-absorbed mercury alloy is filtered off. The remaining filter cake is introduced into a bore or hole of a steel cylinder, and the excess mercury or mercury alloy is pressed out by a stamp or punch.

The final result is a rather brittle press element. This press element is pulverized and the resulting grains or powder is then formed into suitable pills or press bodies of the respective dimension which will retain the desired quantity of mercury.

By changing the compressive force applied in the cylinder, the mercury content within the press body can be varied.

As a first or sole metal for the press body, all elements of the fourth to the eighth subgroup of the periodic system are theoretically suitable, insofar as they do not form an alloy with mercury, but can be wetted by mercury. In actual practice, only those metals can be used which are not toxic and/or radioactive, and which, additionally, are sufficiently inexpensive so that press bodies or, finally, introduction pills or mercury retention pills, which are inexpensive enough for commercial use will be obtained. Suitable metals which meet these requirements are iron and nickel; as a second metal, copper is suitable in order to obtain sufficient resistance to oxidation. Good storage and introduction or retention characteristics can also be obtained with press bodies of iron, chromium, and possibly nickel.

The manufacture of the press body and introduction of the press body into the discharge vessel can at times be carried out within a protective gas atmosphere; if so, the addition of a second metal to prevent oxidation then is not needed. It has been found that press elements made of iron which do not have oxidation-inhibiting metal added thereto will, in due course cause mercury drops to be emitted—besides vaporization of mercury—since, with increasing oxidation, the wetting characteristic of the body is reduced. This is particularly the case if the retention elements are stored in ambient air.

Example 1

Particularly good results with respect to mercury retention and storage, resistance against oxidation and ready release of mercury upon heating in a discharge vessel can be obtained from press elements which are made of:

75% to 99.5% iron
remainder (to 100%) 25% to 0.5% copper.

Example 2

Press elements which have particularly good mercury retention storage capability and have high oxidation resistance have the composition:

55% to 80% nickel
45% to 20% copper.

These press elements have a disadvantage in that, at room temperature, about half of the mercury is still retained and released only when the temperature reaches about 80°-100° C.

Example 3

65% to 75% iron
12% to 25% chromium
23% to 0% nickel.

Example 3 illustrates that compositions of iron and chromium, and nickel, if desired, can be used. Press bodies or introduction or retention pills of this example do not have the high oxidation resistance of the retention elements or pills of Examples 1 and 2.

DRAWINGS

Figure 2:
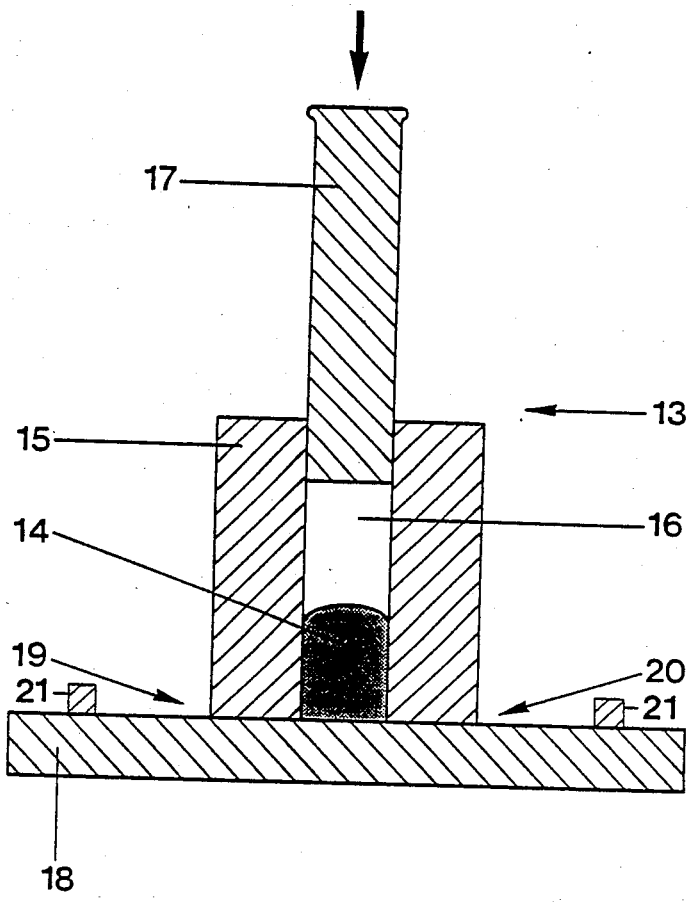

FIG. 1 is a highly schematic side view of an electrolysis vessel to make a mercury—metal suspension; and FIG. 2 is a schematic vertical cross-sectional view through a steel cylinder to press out a filter cake.

DETAILED DESCRIPTION OF METHOD AND APPARATUS USED IN CONNECTION THEREWITH TO MAKE RETENTION ELEMENTS OR PILLS

The electrolysis vessel 1 of FIG. 1 is used to make a mercury—metal suspension. It is made of a double-wall glass vessel 2 which has an inlet 3 and an outlet 4 for introduction and drain of cooling water. A metal cylinder 5 forms the anode, connectable via a cable 6 with the positive terminal of a d-c source, not shown. The metal cylinder 5 has a central opening 7 through which a stirrer 8 is fitted made of glass. The cathode is formed by a pool of mercury 9 and is connected over a copper wire 10 with the negative terminal of the d-c electrical source.

An electrolyte 11 is located above the mercury cathode 9 in form of a metal salt solution. The metal of the salt solution matches that of the anode. Upon application of a d-c voltage, mercury is enriched with the metal of the electrolyte 11. The stirrer 8 insures uniformity, upon rotation. The mercury-metal suspension can be drained by a drain valve 12, and removed from the bottom of the vessel.

FIG. 2 illustrates a steel cylinder 13 to press out the filter cake 14. The steel cylinder has a cylindrical portion 15 with a circular central opening or bore 16 of, for example 1½ cm diameter. The filter cake 14 is located within the bore or opening 16. A punch or piston or press element 17 is then fitted in the bore 16. The cylinder portion 15 is secured with a polished end face to a hardened steel plate 18. A pressure schematically indicated by an arrow coaxial with the stamp 17 of up to about $7 \cdot 10^8$ Pascal is applied to the stamp 17. Upon application of pressure on the stamp 17, excess mercury is pressed out of the filter cake 14. The mercury 14 will ooze or trickle through tiny gaps or scratches formed between the cylindrical portion 15 and the steel plate 18 and will emerge at the edges of the cylinder 15 on the plate 18 as indicated by the points 19, 20. A rim 21 retains excess mercury.

EXAMPLE FOR MANUFACTURE OF A RETENTION ELEMENT MADE OF IRON AND COPPER

Example 4

1.5 kg mercury are placed in an electrolysis vessel (FIG. 1) having an iron anode; 1.5 kg mercury are placed in a similar electrolysis vessel having a copper anode. An electrolyte of about 0.2 liter and containing 6 g $FeSO_4$, 10 ml concentrated $H_2SO_4$, and an additive of 10 g $(NH_4)_2SO_4$ and 10 ml ethanol is added in the electrolysis vessel with the iron anode. A d-c voltage of 20V is applied, at a current of 20A. Upon continuous stirring and an electrolysis time of 20 minutes, a mercury-iron suspension having an iron proportion of about 0.5% per weight is obtained.

The electrolyte in the electrolysis vessel having the copper anode also is 0.2 liter and contains 20 g $CuSO_4$ which will have $NH_3$ added thereto until the solutions clears. At a voltage of 10V and a current of 40A, and after an electrolysis time of about 20 minutes upon continuous stirring, a mercury copper suspension with a copper proportion of about 1% is obtained.

The two mercury-metal suspensions are so mixed that the metal components besides the mercury will be 95% iron and 5% copper.

The resulting mercury-metals suspension is coated with water-free glycerine and tempered at 240° C. for one hour. After decanting of the glycerine, the suspension product is washed and dried. By subsequent filtering of excess mercury by means of a glass frit of porosity G3, the metal proportion is increased tenfold. The resulting filter cake is filled in the steel cylinder—see FIG. 2—and under high pressure to be described below, the remaining excess mercury is pressed out by the stamp or press plunger. The so made press body is pulverized, and by an eccenter press disk-formed press pills of 1.5 mm diameter and about 0.4 mm height are made. In dependence on the pressure of the stamp or plunger 17 (FIG. 2), the proportion of mercury to the press pill can be obtained as follows:

Example 5

At $5.7 \cdot 10^7$ Pa pressure, mercury within the press pill: 74%

Ex. 6: at $11.3 \cdot 10^7$ Pa pressure, mercury within the press pill: 66%

Ex. 7: at $22.6 \cdot 10^7$ Pa pressure, mercury within the press pill: 63%

Ex. 8: at $56 \cdot 10^7$ Pa pressure, mercury within the press pill: 60%.

The metal content of the mercury metal suspension, after electrolysis, is very low: 0.5% to 1%. By filtering, the metal component in the remaining filter cake will increase to between 5% to 8%, and the subsequent pressing process—FIG. 2—increases this metal content by a further factor of from 5 to 10. The pressing of the filter cake—FIG. 2—can be used to vary the mercury content within the retention bodies eventually obtained within some limits—see the above Examples 5–8. The tempering, effected by coating the mercury-metal suspension product with glycerine, free from water, and subsequent heat treatment at at least 100° C., causes growth of crystals, which substantially improves the subsequent filtering. The tempering also permits dissociation of mercury alloys which might have formed with a metal which was used in the mercury-metal suspension product, so that the metals which may form an alloy with each other are, in effect, free from mercury.

The retention bodies or pills store, per unit weight of the metal, a precisely predeterminable quantity of the mercury or mercury alloy. The tolerance, keeping all process conditions the same, varies by at the most ±10%. Thus, any desired quantity of mercury or mercury alloy can be obtained merely by varying the weight of the retention body. The retention body can be readily introduced into discharge lamps.

The electrolysis can be carried out under enhanced conductivity conditions by adding ammonium sulfate to the electrolyte vessel. Possibly anodic oxidation can be effectively suppressed by the addition of ethanol. Uniformity of enrichment is achieved by stirring the mercury or mercury alloy, respectively and the metal salt solution during electrolysis.

The mercury-metal suspension within the electrolysis vessel can be obtained in a batch process, that is, periodically, or in a continuous process. In a continuous process, a certain quantity of already obtained mercury-metal suspension is drawn off at the bottom, and a corresponding quantity of pure mercury is refilled at the top.

Various changes and modifications may be made within the scope of the inventive concept.

Mercury alloys which are liquid and which can be effectively retained by the retention bodies and made in accordance with the present invention are, for example:

Liquid mercury alloy of indium with a proportion of (by weight) 40% mercury and 60% indium. Compositions of indium are particularly suitable for use with fluorescent lamps in luminaires at elevated temperatures. A typical pellet or pill of 1.5 mm diameter and about 0.4 mm height will have approximately 3.5 mg mercury therein suitable for introduction into a compact 9 Watt fluorescent lamp of 27 cm axial length. This quantity of mercury corresponds to a single drop or spherical mercury particle of 0.8 mm diameter which, as can be seen, can hardly be handled by automatic manufacturing machinery.

The present invention permits introduction of such minute quantities of mercury in compact fluorescent lamps, for example of less than 10W power, and having a discharge vessel volume of as low as 19 $cm^3$, although, of course, the invention is not restricted to such small lamps, but can be used with lamps of any size by merely increasing the size of the pill or pellet, and/or introducing a plurality of pills or pellets into lamps requiring a greater amount of mercury. For example, a fluorescent lamp of the type T8 of 40 Watt having a discharge vessel volume of 630 $cm^3$ requires 10 milligram of mercury. Introducing a pellet made in accordance with Examples 1 and 6 having a weight of 15 mg provides merely the required quantity of mercury content, with a tolerance of ±10%. Practicing the prior art introduction of mercury into fluorescent lamps, by placing a drop of mercury directly into fluorescent lamp, results in an introduction of, on average, 25 milligram mercury, which is vastly in excess of the required quantity.

I claim:

1. Mercury-containing or mercury-alloy-containing retention structure, particularly to introduce liquid mercury or liquid mercury alloy into a discharge lap, in a predetermined quantity, comprising, a predetermined quantity of liquid mercury or mercury alloy, a porous pressed body retaining in its pores the predetermined quantity of mercury or mercury alloy, said porous pressed body comprising a metal which has the characteristics of:

the melting point of the metal is over 250° C;

the metal of the body does not form an alloy with mercury;

the metal can be wetted by mercury; and wherein said metal comprises (i) more than 50%, by weight, of iron, and (ii) chromium and nickel.

2. In a method of manufacturing a discharge lamp, the step of introducing a pill or pellet comprising the mercury or mercury alloy retention structure as claimed in claim 1 into the discharge vessel of a fluorescent lamp.

3. In combination with an electric discharge lamp, a pill or pellet comprising the mercury or mercury alloy retention element of claim 1, wherein said body retains liquid mercury, or a liquid mercury alloy and, by weight, has the composition:

25% to
65% metal

75% to
35% liquid mercury or liquid mercury alloy.

4. Method of making a liquid mercury or liquid mercury alloy retention element, for handling of liquid mercury or liquid mercury alloy, and particularly for introduction of minute amounts of mercury or mercury alloy into a discharge vessel of a discharge lamp, comprising, the steps of (a) introducing the mercury or mercury alloy in an electrolysis vessel (1) having a metal salt solution therein and an anode (5) of the corresponding metal, wherein the metal comprises an element which, solely or as a mixture or alloy, does not form an alloy with mercury or the mercury alloy, and is wetted by mercury, (b) enriching the mercury or mercury alloy with the respective metal of the salt solution by electrolytic enrichment to form a mercury-metal suspension;

(c) coating the resulting mercury-metal suspension with aqueous-free glycerine and tempering said coated suspension at a temperature of at least 100° C.;

(d) decanting the glycerine, washing the suspension product, and drying the suspension product;

(e) filtering off excess non-absorbed mercury or mercury alloy and forming a filter cake;

(f) introducing the resulting filter cake into a press and pressing-out excess mercury or mercury alloy under high pressure; and (g) pulverizing the then brittle pressed body, and forming from the resulting powder, said retention elements of predetermined weight or dimension.

5. The method of claim 4, including, in step (a), adding ammonium sulfate to increase the conductivity of the electrolyte.

6. The method of claim 4, including, in step (a), adding ethanol to the electrolyte vessel to inhibit anodic oxidation.

7. The method of claim 4, including, in steps (a) and (b), the step of stirring the mixture of mercury or mercury alloy and the metal salt solution essentially continuously with a stirrer (8).

8. The method of claim 4, wherein said steps (a) and (b) are carried out in a continuous process in the vessel (1) including the step of drawing-off from the bottom of the vessel the formed mercury-or mercury alloy-metal suspension and adding mercury or mercury alloy at the top of the vessel.

9. The method of claim 4, wherein the step (f) of pressing-out excess mercury or mercury alloy comprises introducing the filter cake into a bore of a steel cylinder (13);

and pressing-out the excess mercury or mercury alloy by applying a high pressure to a stamp o plunger (17) fitting into the bore, while permitting the mercury or mercury alloy to escape from the bore through minute openings in a bottom of the steel cylinder (13).

10. The method of claim 4, wherein a plurality of electrolyte vessels are utilized, each having a respective anode of different metals, and an electrolyte of a different metal salt therein;

carrying out the steps (a) and (b) in the respective electrolyte vessels (1) to form the respective mercury-or mercury alloy- metal suspensions;

and then, before carrying out the step (c), carrying out the further step of mixing the respective mercury or mercury alloy metal suspensions in predetermined proportions.

11. The method of claim 10, wherein the metals of the metal salt solutions and the anodes in the respective electrolysis vessels comprise iron and copper, respectively.

12. The method of claim 11, wherein the proportion of metals of the resulting mercury or mercury alloy metal suspension is:

75% to 99.5% iron
remainder, to 100%, 25% to 0.5% copper,
percentages by weight.

13. The method of claim 10, wherein the metals of the metal salt solutions and the anodes in the respective electrolysis vessels comprise nickel and copper, respectively.

14. The method of claim 13, wherein the proportion of metals of the resulting mercury or mercury alloy metal suspension is:

55% to 80% nickel
remainder, to 100%, 45% to 20% copper,
percentages by weight.

15. The method of claim 10, wherein the metals of the metal salt solutions and the anodes in the respective electrolysis vessels comprises iron, chromium and nickel, respectively.

16. The method of claim 15, wherein the proportion of metals in the resulting mercury or mercury alloy metal suspension is:

65% to 75% iron
12% to 25% chromium
remainder, to 100%, 23% to 0% nickel.

17. The method of claim 4, wherein said step (f) of pressing out the excess mercury or mercury alloy comprises subjecting the filter cake to a pressure of at least $5 \cdot 10^{-7}$ Pascal;

and controlling the remaining proportion, by weight, of mercury or mercury alloy within the filter cake by controlling the pressure in the direction of reducing the proportion of mercury or mercury alloy to said metal upon increase of pressure.

18. The method of claim 4, wherein said step (g) forming said retention element comprises forming a pill or pellet of a diameter in the order of about 1.5 mm and having a height or thickness of up to about 0.5 mm.

19. The method of claim 4, wherein the metal, which, besides the mercury, forms the major metallic proportion of the mercury-metal suspension, comprises an element of the fourth to the eighth subgroup of the periodic system.

20. Mercury-containing or mercury-alloy-containing retention structure, particularly to introduce liquid mercury or liquid mercury alloy into a discharge lamp, in a predetermined quantity, comprising, a predetermined quantity of liquid mercury or mercury alloy, a porous pressed body retaining in its pores the predetermined quantity of mercury o mercury alloy, said porous pressed body comprising a metal which has the characteristics of:

the melting point of the metal is over 250° C;

the metal of the body does not form an alloy with mercury;

the metal can be wetted by mercury; and wherein said metal comprises more than 50%, by weight of iron, and (ii) copper.

21. The structure of claim 20, wherein said metal comprises

75–99.5% iron, remainder, to 100%, 25% to 0.5% copper, all percentages by weight.

22. Mercury-containing or mercury-alloy-containing retention structure, particularly to introduce liquid mercury or liquid mercury alloy into a discharge lamp, in a predetermined quantity, comprising, a predetermined quantity of liquid mercury or mercury alloy, a porous pressed body retaining in its pores the predetermined quantity of mercury o: mercury alloy, said porous pressed body comprising a metal which has the characteristics of:

the melting point of the metal is over 250° C;

the metal of the body does not form an alloy with mercury;

the metal can be wetted by mercury; and wherein said metal comprises (i) more than 50%, by weight, of nickel, and (ii) copper.

23. The structure of claim 22, wherein said metal comprises

55–80% nickel, remainder, to 100%, 45% to 20% copper, all percentages by weight.

24. Mercury-containing or mercury-alloy-containing retention structure, particularly to introduce liquid mercury or liquid mercury alloy into a discharge lamp, in a predetermined quantity, comprising, a predetermined quantity of liquid mercury or mercury alloy, a porous pressed body retaining in its pores the predetermined quantity of mercury or mercury alloy, said porous pressed body comprising a metal which has the characteristics of:

the melting point of the metal is over 250° C;

the metal of the body does not form an alloy with mercury;

the metal can be wetted by mercury; and wherein said metal comprises 65–75% of iron, 12–25% of chromium, and 23–0% of nickel, all percentages by weight.

25. A method of making a liquid mercury or liquid mercury alloy retention element, for handling of liquid mercury or liquid mercury alloy and particularly for introduction of minute amounts of mercury or mercury alloy into a discharge vessel of a discharge lamp, comprising the steps of forming a suspension of a metal or metal alloy which does not form an alloy with the mercury or the liquid mercury alloy but is wetted by the mercury or the liquid mercury alloy;

coating the resulting mercury-metal suspension with aqueous-free glycerine and tempering said coated suspension at a temperature of at least 100° C;

decanting the glycerine, washing the suspension product, and drying the suspension product;

filtering the suspension, to remove excess mercury or liquid mercury alloy and to form a filter cake;

pressing the filter cake to further remove excess mercury or mercury alloy and form a brittle pressed body;

pulverizing the brittle pressed body to form a retention element powder; and forming the retention element from said retention element powder.

26. The method of claim 25 wherein the step of forming the suspension comprises electrolytically enriching the mercury or mercury alloy with said metal or metal alloy in an electro-winning or electro-plating process wherein the mercury or mercury alloy is used as a cathode.

27. The method of claim 26, wherein the electrolytically enriching step comprises introducing the mercury or mercury alloy into an electrolysis cell as said cathode, said cell containing an electrolyte;

using the metal or metal alloy as an anode; and using, as the electrolyte, a solution containing ions of said metal or metal alloy.

28. The method of claim 27, wherein the filtering step further comprises increasing the crystal size of the suspension before filtering by coating the suspension with aqueous-free glycerine and tempering the coated suspension at a temperature of at least 100° C.

* * * * *

UNITED STATES PATENT AND TRADEMARK OFFICE

CERTIFICATE OF CORRECTION

PATENT NO. : 4,808,136

DATED : February 28, 1989

INVENTOR(S) : W. Schuster

It is certified that error appears in the above-identified patent and that said Letters Patent is hereby corrected as shown below:

Column 7, line 8, "lap" should read --lamp--.

Column 8, line 26, "o" should read --or--.

Column 9, line 29, "o" should read --or--.

Column 9, line 37, after the word "comprises" add --(i)--.

Column 9, line 51, "o:" should read --or--.

Signed and Sealed this

Sixth Day of March, 1990

*Attest:*

*Attesting Officer*

JEFFREY M. SAMUELS

*Acting Commissioner of Patents and Trademarks*